US005711112A

United States Patent [19]

Barten et al.

[11] Patent Number: 5,711,112

[45] Date of Patent: Jan. 27, 1998

[54] DOUBLE-DRIVE AUTOMATIC SLIDING DOOR OPERATOR

[75] Inventors: Michael T. Barten, Berlin; Rüdiger Löb, Hennigsdorf; Helmut L. Schröder-Brumloop; Mustapha Toutaoui, both of Berlin, all of Germany

[73] Assignee: Otis Elevator Company, Farmington, Conn.

[21] Appl. No.: 711,366

[22] Filed: Sep. 3, 1996

[51] Int. Cl.[6] ..... E05C 7/06

[52] U.S. Cl. ..... 49/118; 49/123; 49/360

[58] Field of Search ..... 49/360, 116, 118, 49/123, 117, 120, 121, 361; 318/34, 85, 49

[56] References Cited

U.S. PATENT DOCUMENTS

| | | | |
|---|---|---|---|
| 1,904,010 | 4/1933 | Peelle | 49/120 X |
| 3,807,091 | 4/1974 | Peelle et al. | 49/120 |
| 3,863,390 | 2/1975 | Sawdai | 49/360 |
| 4,259,810 | 4/1981 | West | 49/123 X |
| 4,593,793 | 6/1986 | Salmon | 187/56 |
| 4,781,270 | 11/1988 | Holland | 187/56 |
| 5,063,334 | 11/1991 | Tanita et al. | 318/568.1 |

FOREIGN PATENT DOCUMENTS

| | | | |
|---|---|---|---|
| 452226 | 10/1949 | Italy | 49/116 |
| 25070 | of 1912 | United Kingdom | 49/360 |

OTHER PUBLICATIONS

Fermator PCC4 data sheet (one page), Jun. 1996.

*Primary Examiner*—Jerry Redman

[57] ABSTRACT

An automatic sliding door operator includes a top door operator and a bottom door operator, each operator having a motor driven sprocket driving a tooth belt to which the sliding doors are attached, the motors being separately driven in a position-synchronized fashion in response to related encoders connected with each motor to provide positional information.

5 Claims, 2 Drawing Sheets

DOUBLE-DRIVE AUTOMATIC SLIDING DOOR OPERATOR

TECHNICAL FIELD

This invention relates to automatic sliding door operators such as those used on elevator doors, and more particularly to a door operator which includes a motor for driving the top of the door and a motor for driving the bottom of the door, and synchronized controls therefor.

BACKGROUND ART

Automatic sliding doors are utilized at the entrances of buildings, in elevators, and in public transportation facilities. The desired characteristics of door operators include high speed, low noise and minimal space. For some applications, such as the use of glass doors, the door operator mechanism must be located out of the view of users. A common form of door operator is located behind the top door lintel above the door suspension mechanisms (rollers and tracks). This type of door operator has a tendency to tilt the door because the point of driving force not through the inertial center of the door panels. Although it is known to use lever-type door operators to apply the force near the inertial center of the door panel, lever-type systems are of no use where glass doors are involved.

DISCLOSURE OF INVENTION

Objects of the invention include an automatic sliding door opener which can be disposed in a position where it is invisible to the user, which is capable of high speed, which provides no tilt to the doors, and which is not noisy and provides no net force or torque inputs into the mounting environment thereof.

According to the present invention, two separate door drives, each with its own motor, separately drive the top and bottom of a sliding door. In accordance with the invention, the motors are position-synchronized so that the door panel will not tilt when being opened or closed. According further to the invention, the top and bottom of the door are separately moved to an open or closed position by being linked to an endless drive member, such as a belt, the belts being driven by motors which simultaneously run in opposite directions. In one embodiment of the invention, the belts are tooth belts driven by complementary sprockets or gears. The disclosed embodiment includes center opening, double doors of the type used in an elevator.

The invention is readily implementable utilizing adaptations of door drive hardware which already exists and has been proven to be acceptable. The invention provides a door drive having improved performance and increased power, and which can be mounted so as to be invisible to the users. The invention permits use of smaller motors and gears that allow installation in a relatively small amount of space, and simplifies the mechanical design. The use of separate drives also reduces noise and maintenance problems.

The invention also provides operation even with single-motor failure. The operation will be degraded by door tilting, but will keep the elevator in service until repaired.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
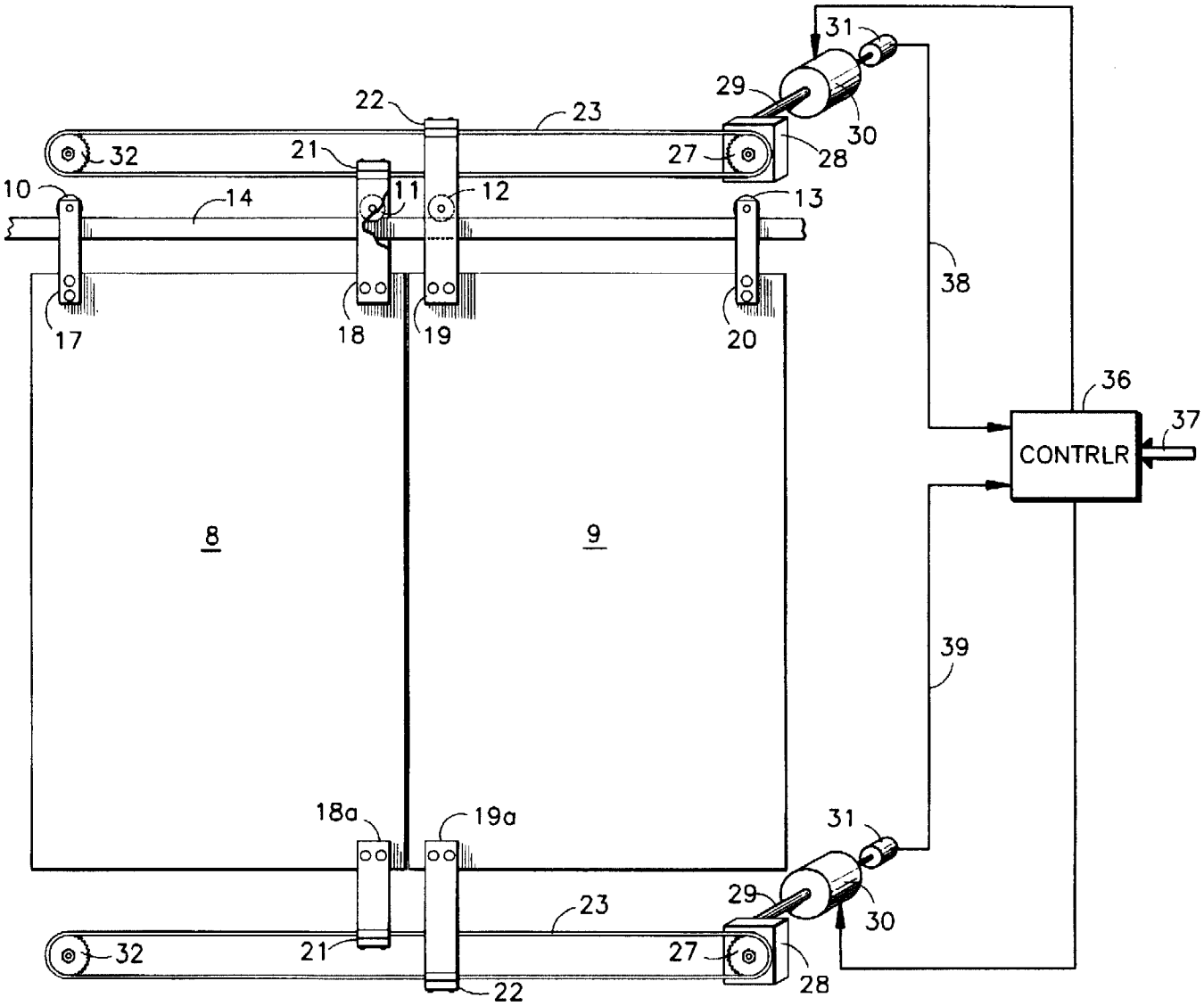
FIG. 1 is a partial, partially schematic, front elevation view of elevator doors and a door drive in accordance with the present invention.

Referring now to FIG. 1, a pair of door panels 8, 9 are each supported by rollers 10–13 which are in turn supported by a track 14. The rollers are pivoted to hangers 17–20, the hangers 18, 19 also comprising clamps 21, 22 to secure them to a tooth belt 23 that will cause the hangers 17–20 to move in opposite directions whenever it moves. The hangers 17–20 are fastened to the door panels in any suitable way.

The tooth belt 23 is driven by a sprocket 27 which is driven by a gear box 28 in response to a shaft 29 driven by an electric motor 30. The shaft 29 also rotates an encoder 31. An idler pulley or sprocket 32 guides the tooth belt 23, in a known fashion.

At the bottom of the doors, similar apparatus is provided, identified by the same reference numerals for like parts at the top of the door. The only difference is, the brackets 18*a* and 19*a* do not also serve as hangers, and additional hangers 17, 20 and rollers 10–13 are not required. There may be door guides (not shown) of a conventional sort at the bottom of the door panels 8, 9.

A controller 36, which may typically comprise a suitably programmed microcomputer, or be implemented by suitable programs within any computer of an elevator or other system where the invention is used, may receive door command signals over lines 37. The controller also receives position-indicating signals on lines 38, 39 from the encoders 31. As described more fully with respect to FIG. 2 hereinafter, the controller 36 will utilize positional information to cause door motion to follow the plan of a door profile, which is typically speed as a function of instantaneous door panel position.

Figure 2:
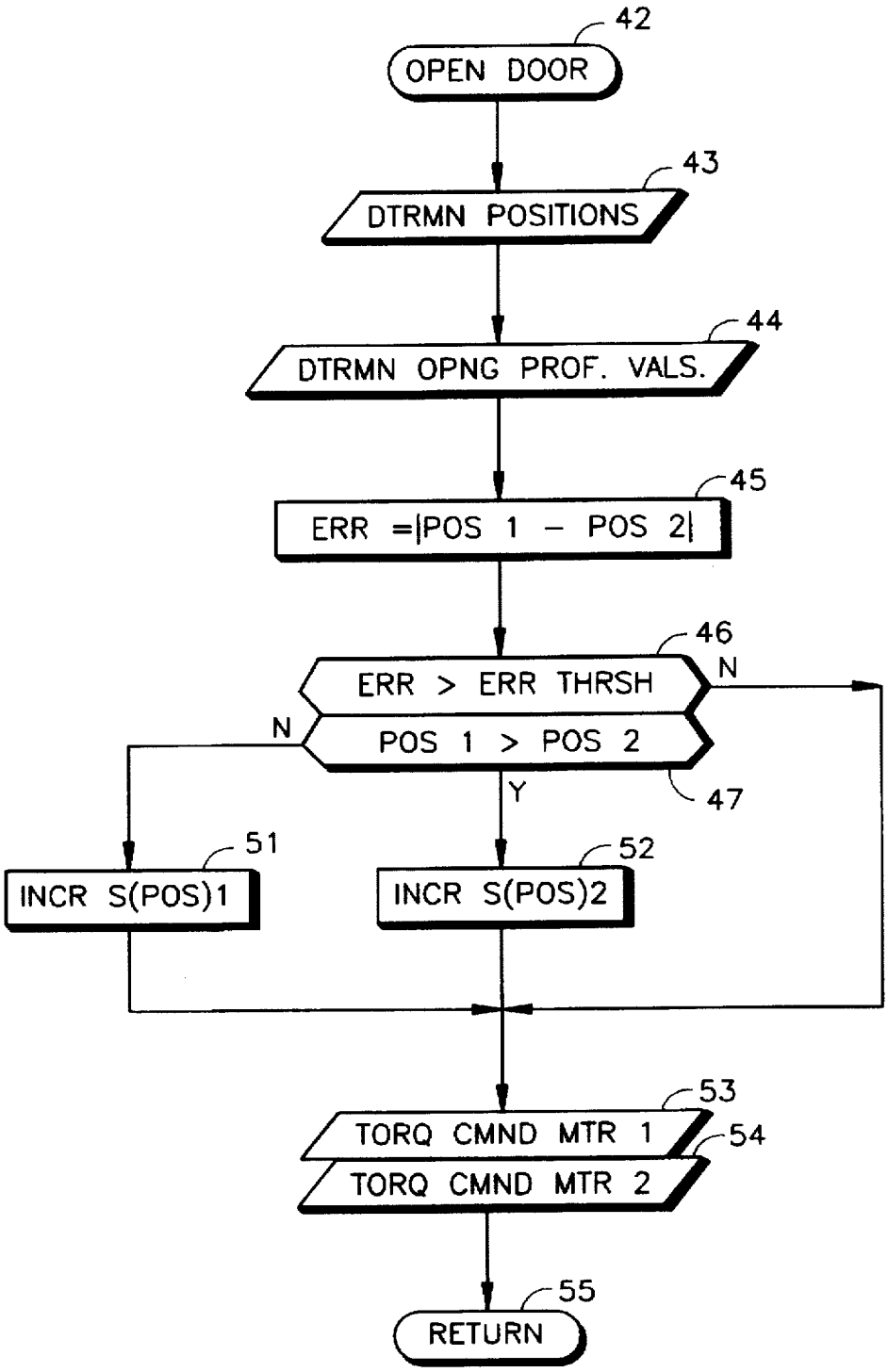
FIG. 2 is a simplified logic flow diagram of a routine for controlling the motors in a synchronized fashion during a door opening operation.

Referring to FIG. 2, a simplified, exemplary open door routine is reached through an entry point 42 and a first subroutine will determine the absolute position of each of the door panels. This routine may vary depending upon the type of encoder used. If an incremental encoder (a tachometer) is used, then the pulses therefrom must be integrated to provide an indication of door position. If a full, binary position encoder is used, the code need simply be read to determine the current absolute position of each door panel. Next, a subroutine 44 utilizes the positions determined in the subroutine 43 to provide a speed value dictated by a motion profile for door opening, which is preestablished in a well-known way. In the usual case, the door opening profile for the top operator will be the same as the door opening profile for the bottom operator. Then in a step 45, an error value, ERR, is provided as the absolute value of the difference in position of the top operator from that of the bottom operator. Then, a test 46 determines if the error of step 45 is greater than some error threshold which, is determined to be an amount of difference in the positioning of the top door operator from that of the bottom door operator which is worthy of a correction. If the error is not greater than the threshold, no correction is made. But if the error is greater than the threshold, an affirmative result of test 46 reaches a test 47 to determine whether the top operator or the bottom operator has the greater position (meaning that it has traveled further). Since test 46 determines that one of them is significantly different than the other, there is no possibility of them being equal in test 47. Therefore, a negative result of test 47 reaches a step 51 to increment the value of desired speed, S, as a function of the present position determined for the top door operator, so as to cause the speed of the top door operator to be higher than it would normally be at this particular position. This will allow the top door operator to catch up to the position of the bottom door operator. On the other hand, if the position of the top operator is greater than the position of the bottom operator, an affirmative result of test 47 reaches a step 52 to increase the speed of the bottom door operator so it can catch up to the top door operator. If test 46 has a negative result, the test and steps 47, 51, 52 are bypassed.

Then a pair of subroutines 53, 54 generate the torque command for the two motors, separately. The subroutines 53, 54 simply perform the normal motor command generation, depending on the type of motor used. For instance, if pulse width modulated VVVF motors are used, both the voltage and the frequency may be controlled. Other motors will have other type commands, in a known way. This is irrelevant to the present invention. Once the new commands for the motors are generated by the subroutines 53, 54, other programming is reached through a return point 55.

Although not shown herein, a nearly identical routine will be utilized for closing the door. In fact, the routine can be the same routine, with an election as to which motion profile, opening or closing, is to provide the speed values for controlling the motors. All this is well within the skill of the art and not critical to the present invention.

In its broadest sense, the invention includes use of separate motors to drive the top and bottom, respectively, of a sliding door panel; in suitably matched systems, the synchronizing may not be required. Although the flexible member in this embodiment is a tooth belt, it may also be a plain belt, a rope, a chain or a cable, as may be appropriate in any given use of the invention. The invention may be used with single door panels or with two-speed, telescoping doors, including side opening double doors or central opening quadruple doors.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A sliding door operator, comprising:

a slidable door panel having a top and a bottom;

a first endless flexible member connected to the top of said door panel;

first rotary means including a bidirectional electric motor for causing said flexible member to translate longitudinally in either one of two horizontal directions, one direction causing said door panel to move one way thereby opening said door, and the other direction causing said door panel to move another way thereby closing said door;

characterized by the improvement comprising:

a second endless flexible member connected to the bottom of said door panel;

second rotary means including a bidirectional electric motor for causing said second flexible member to translate longitudinally in either one of said two directions;

a first encoder interconnected with said first flexible member for providing first signals indicative of the translation thereof;

a second encoder interconnected with said second flexible member for providing second signals indicative of the translation of said second rotary means; and control means for providing speed signals indicative of desired speed as a function of position in a preestablished motion profile and responsive to said first and second signals for providing separate command signals to each of said motors in accordance with said motion profile.

2. A system according to claim 1 wherein:

said controller determines from said first and second signals if one of said flexible members has traveled less distance than the other of said flexible members, and alters said desired speed value of one of said motors from that indicated by said speed signals in a manner to tend to cause a lagging one of said flexible members to catch up with the position of the other one of said flexible members.

3. A system according to claim 1, comprising:

a second door panel having a top and a bottom, said first flexible member connected to the top of said second door panel in a manner such that translation of said first flexible member in said one direction will cause said second door panel to move in said another way, thereby opening said door, and so that translation of said first flexible member in said other direction will cause said second door panel to move in said one way, thereby closing said door, and the bottom of said door being connected to said second endless flexible member in a manner to cause said second door panel to move in either one of said two directions oppositely to the motion of said first door panel.

4. A system according to claim 1 wherein said two motors rotate in mutually opposite directions.

5. A system according to claim 1 wherein each of said rotary means comprises a sprocket.

* * * * *